US010111311B2

(12) United States Patent
Koga

(10) Patent No.: US 10,111,311 B2
(45) Date of Patent: Oct. 23, 2018

(54) EMITTER AND X-RAY TUBE DEVICE HAVING THE SAME

(71) Applicant: SHIMADZU CORPORATION, Nakagyo-Ku, Kyoto-Shi, Kyoto (JP)

(72) Inventor: Yusuke Koga, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 64 days.

(21) Appl. No.: 15/454,466

(22) Filed: Mar. 9, 2017

(65) Prior Publication Data

US 2017/0265289 A1 Sep. 14, 2017

(30) Foreign Application Priority Data

Mar. 14, 2016 (JP) ..... 2016-049959

(51) Int. Cl.
*H01J 35/06* (2006.01)
*H05G 1/56* (2006.01)
*H05G 1/54* (2006.01)

(52) U.S. Cl.
CPC ..... *H05G 1/56* (2013.01); *H01J 35/06* (2013.01); *H05G 1/54* (2013.01)

(58) Field of Classification Search
CPC ..... H01J 35/04; H01J 35/06; H01J 2235/06; H05G 1/08; H05G 1/34; H05G 1/46; H05G 1/54; H05G 1/56; H05G 1/58
See application file for complete search history.

(56) References Cited

U.S. PATENT DOCUMENTS 3,914,639 A * 10/1975 Barraco ..... H01J 1/22 313/271
6,259,193 B1 * 7/2001 Lipkin ..... H01J 1/18 313/271
6,464,551 B1 * 10/2002 Lipkin ..... H01J 1/18 445/50

(Continued)

FOREIGN PATENT DOCUMENTS

JP 2015-115139 6/2015
WO WO 2014/041639 8/2016

*Primary Examiner* — Thomas R Artman
(74) *Attorney, Agent, or Firm* — Andrew F. Young, Esq.; Lackenbach Siegel, LLP

(57) ABSTRACT

An emitter that can be lighted even if a line of any part thereof is broken by ensuring an electric pathway. The X-ray tube device includes an electron emission surface P having an electric pathway; electric heating elements 21, 22 that are connected electrically to both ends of said electron emission surface; and two branched terminals that are branched in the middle of the electric pathway of the electron emission surface P between electric heating elements 21 and 22; second electric heating element, in order from the electric heating element 21 as the supporting element 23 and the supporting element 24; and further comprises: a relay 33A that switches the electric heating element 21 and the supporting element 24 to be in a short-circuit/open condition and a relay 33B switches the electric heating element 22 and the supporting element 23 to be in a short-circuit/open condition. A bypass electric pathway may be formed where the short-circuit condition is switched on and such bypass electric pathway can exist at all locations relative to the electric pathway between the electric heating elements 21 and 22.

4 Claims, 21 Drawing Sheets

(56) References Cited

U.S. PATENT DOCUMENTS

| | | | | |
|---|---|---|---|---|
| 7,693,265 | B2 * | 4/2010 | Hauttmann | H01J 35/06 378/136 |
| 9,202,663 | B2 * | 12/2015 | Yoshizawa | H01J 35/06 |
| 9,530,603 | B1 * | 12/2016 | Kobayashi | H01J 35/06 |
| 9,826,613 | B2 * | 11/2017 | Tomita | H01J 35/06 |
| 9,887,061 | B2 * | 2/2018 | Kobayashi | H01J 35/06 |
| 2009/0103683 | A1 * | 4/2009 | Hauttmann | H01J 35/06 378/119 |
| 2014/0153698 | A1 * | 6/2014 | Yoshizawa | H01J 35/06 378/136 |
| 2015/0262782 | A1 * | 9/2015 | Kobayashi | H01J 35/06 378/136 |
| 2016/0128169 | A1 * | 5/2016 | Tomita | H01J 35/06 378/138 |
| 2017/0265289 | A1 * | 9/2017 | Koga | H01J 35/06 |

* cited by examiner

*FIG. 14(a)* *FIG. 14(b)* *FIG. 14(c)* *FIG. 14(d)*
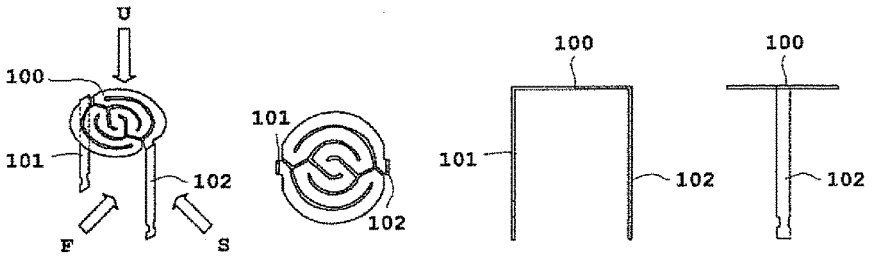

*FIG. 16(a)* *FIG. 16(b)* *FIG. 16(c)* *FIG. 16(d)*
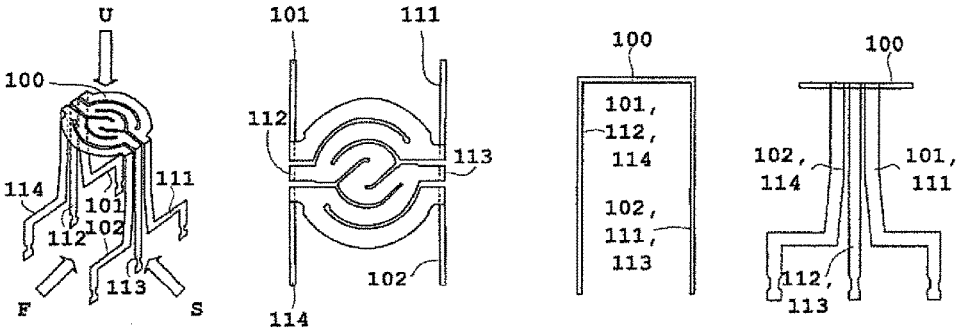

EMITTER AND X-RAY TUBE DEVICE HAVING THE SAME

CROSS REFERENCE TO RELATED APPLICATIONS

This application relates to, and claims priority from JP Ser. No.: 2016-049959 filed Mar. 14, 2016, the entire contents of which are incorporated herein by reference.

FIGURE SELECTED FOR PUBLICATION

FIG. 6(A)-6(C)

BACKGROUND OF THE INVENTION

Field of the Invention

The present invention relates to an emitter having an electric pathway (energizing path) through which electricity passes, and further relates to an X-ray tube device comprising the same, and particularly relates to a technology that can provide a measure determining when a wire of the emitter is broken.

Description of the Related Art

The inventor sets forth a flat emitter for an X-ray tube that is used as an electron source such as an X-ray tube. The present applicant discloses an emitter having a support element (leg) (hereafter "emitter with support element") that is attached to a deformable part and ineffective on electrical heating (e.g., Patent Document 1). Referring to FIG. 14, according to the conventional and general flat emitter (hereafter single emitter), elements connected to the electron emission surface (hereafter simply "emission surface") 100 are two elements for electrical heating (hereafter "electric heating element"). Specifically, an emitter having a pair of electric heating elements is a single emitter.

On the other hand, referring to FIG. 15 or FIG. 16, two electric heating elements (101, 102) (legs) and plural supporting elements 111, 112, are connected to the emission surface 100. Hereafter, referring to FIG. 15, the emitter having two support elements 111, 112 is specified as a "double emitter" and referring to FIG. 16, the emitter having four support elements 111-114 is specified as a "triple emitter". Specifically, an emitter having two pairs consisting of electric heating elements and supporting elements is a double emitter and an emitter having three pairs consisting of electric heating elements and supporting elements is a triple emitter. Due to attachment of such supporting element, deformation of the emission surface, which is caused by sag (downhill (gravity) creep), can be remarkably improved. In addition, the more supporting elements are, the less deformation takes place.

Here, referring to FIG. 14-FIG. 16, F is the front, the sign U is the upper surface and S is the side. FIG. 14A is a schematic perspective view of a single emitter, FIG. 14B is a schematic plan view from the upper surface U of the FIG. 14A, FIG. 14C is a schematic front view from the front F of the FIG. 14A, and FIG. 14D is a schematic side view from the side S of the FIG. 14A. FIG. 15A is a schematic perspective view of a double emitter, FIG. 15B is a schematic plan view from the upper surface U of the FIG. 15A, FIG. 15C is a schematic front view of the front F of the FIG. 15A, and FIG. 15D is a schematic side view of the side S of the FIG. 15A. FIG. 16A is a schematic perspective view of a triple emitter, FIG. 16B is a schematic plan view from the upper surface U of the FIG. 16A, FIG. 16C is a schematic front view of the front F of the FIG. 16A, and FIG. 16D is a schematic side view of the side S of the FIG. 16A.

In addition, relative to an emitter with support element, the present applicant proposes an emitter that can short-circuit an electric pathway near the broken wire by using a relay from outside and can provide an electrical heating at the electric pathway other than the part of the broken wire (e.g., Patent Document 2) when the line of the emitter is broken. Referring to FIG. 17, the double emitter having the above structure is illustrated. When the line is broken at the central part, the electric heating elements 121, 122 short-circuits the supporting elements 123, 124 by using the relay 133, the electrical heating can be conducted through the pathway from the electric heating element 121, the supporting element 123, the relay 133, the supporting element 124 to the electric heating element 122 in order. Accordingly, only circumference part of the emitter (indicated by the shadow area in FIG. 17) can light.

RELATED PRIOR ART DOCUMENTS

Patent Document

Patent Document 1: PCT WO 2014/041639 A

Patent Document 2: JP 2015-115139 A1

ASPECTS AND SUMMARY OF THE INVENTION

Objects to be Solved

Nevertheless, in the case of a conventional example having such structure referring to FIG. 17, following problems are remained to be solved.

Specifically, referring to FIG. 17, relative to an emitter with support element, having only one electric power sources, if the emitter that can short-circuit an electric pathway near the broken line by using a relay from outside when the line of the emitter is broken, electrical heating can be provided at the electric pathway other than the part of the broken line, but when the line of the part other than a specified part is broken, the electrical heating cannot take place.

Referring to FIG. 18 and FIG. 19, the cases of the double emitter are illustrated as examples. When the line of the central part is broken, the electrical heating of the circumference part of the emitter can take place by using the relay 133 and ensuring the electric pathway (indicated by the thick line in FIG. 18). However, when the line of the circumference part is broken, ensuring the electric pathway (indicated by the thick line in FIG. 19) cannot be ensured even by using the relay 133, so that the electrical heating for the emitter cannot take place.

Then, referring to FIG. 20, Patent Document 2 discloses the structure, in which relays 133A. 133B are installed in two locations so that the electric pathway can be ensured when the line of the circumference part other than the central part is broken (referring to Claim 3 and paragraph [0039] of Patent Document 2). However, according to such structure referring to FIG. 20, in contrast to FIG. 18 and FIG. 19, when the line of the central part is broken, the electric pathway indicated by the thick line referring to FIG. 21 cannot form.

Specifically, it is problematic that according to each structure disclosed in Patent Document 2, when the emitter with support element has only one electric power source and the line other than the specific part is broken, electrical heating cannot take place. The line of which part of the emitter is broken may vary depending on the use condition (e.g., electric current and time on electrical heating and so forth), but supposedly when while medical treatment is underway, it is significant that the electric pathway can be ensured to light partially the emitter even when the line of any part of the emitter is broken. In addition, it is desired that the electric pathway of the emission surface can be ensured as long as possible when the line is broken. The area of the emitter at which the emitter can be lighted becomes larger by ensuring the electric pathway for a long time.

Considering such circumstances, the object of the present invention is to provide an emitter that can be lighted even if a line of any part thereof is broken by ensuring an electric pathway and an X-ray tube device having the same.

Means for Solving the Problem

The present invention comprises the following structure to solve such problem.

Specifically, the emitter according to a first invention comprises: an electron emission surface having electric pathway; a first electric heating element and a second electric heating element that are connected electrically to both ends of the electron emission surface; and a first branched terminal and a second branched terminal that are two branched terminals branched in the middle of the electric pathway of the electron emission surface between the first electric heating element and the second electric heating element, in order from the first electric heating element; and further comprises: a first switching element that switches the first electric heating element and the second branched terminal to a short-circuit condition or an open condition; and a second switching element that switches the second electric heating element and the first branched terminal to a short-circuit condition or an open condition. Specifically, the emitter according to a second invention comprises: an electron emission surface having electric pathway; a first branched terminal, a second branched terminal, a third branched terminal, . . . , a n−2 branched terminal, a n−1 branched terminal, and a n-branched terminal, n is an integer bigger than 3, that are n branched terminals branched in the middle of the electric pathway of the electron emission surface between the first electric heating element and the second electric heating element that are connected electrically to both ends of the electron emission surface, in order from the first electric heating element; and further comprises: a first switching element that switches the first electric heating element and the second branched terminal to the short-circuit condition or the open condition; a second switching element that switches the first branched terminal and the third branched terminal to the short-circuit condition or the open condition; . . . ; a n−1 switching element that switches the n−2 branched terminal and the n branched terminal to the short-circuit condition or the open condition; and a n switching element that switches the n−1 branched terminal and the second electric heating element to the short-circuit condition or the open condition.

Action and Effect

According to the aspect of the first invention different from the first invention, the emitter comprises: an electron emission surface having electric pathway; a first electric heating element and a second electric heating element that are connected electrically to both ends of the electron emission surface; and a first branched terminal and a second branched terminal that are two branched terminals branched in the middle of the electric pathway of the electron emission surface between the first electric heating element and the second electric heating element, in order from the first electric heating element; and further comprises: a first switching element that switches the first electric heating element and the second branched terminal to a short-circuit condition or an open condition; and a second switching element that switches the second electric heating element and the first branched terminal to a short-circuit condition or an open condition. Such first switching element and second switching element are equipped, so that a bypass electric pathway can be formed at the location where the short-circuit condition is switched on and accordingly, such bypass electric pathway can always exist at all locations relative to the electric pathway between the first electric heating element and the second electric heating element. In such way, the bypass electric pathway formed by switching to the short-circuit condition and accordingly can be always exist at all locations relative to the electric pathway between the first electric heating element and the second electric heating element, so that an electric pathway can be ensured and the emitter can be lighted even when a line of any part is broken.

Action and Effect

The emitter, according to the aspect of the second invention, comprises: the electron emission surface having an electric pathway; and the first electric heating element and a second electric heating element that are connected electrically to both ends of the electron emission surface. And the emitter comprises: a first branched terminal, a second branched terminal, a third branched terminal, . . . , a n−2 branched terminal, a n−1 branched terminal, and a n-branched terminal, n is an integer bigger than 3, that are n branched terminals branched in the middle of the electric pathway of the electron emission surface between the first electric heating element and the second electric heating element in order from the first electric heating element. The emitter further comprises: a first switching element that switches the first electric heating element and the second branched terminal to the short-circuit condition or the open condition; a second switching element that switches the first branched terminal and the third branched terminal to the short-circuit condition or the open condition; . . . ; a n−1 switching element that switches the n−2 branched terminal and the n branched terminal to the short-circuit condition or the open condition; and a n switching element that switches the n−1 branched terminal and the second electric heating element to the short-circuit condition or the open condition. Such first switching element, and second switching element, . . . , n−1 switching element are equipped, so that the bypass electric pathway can be formed at the location where the short-circuit condition is switched on and accordingly, such bypass electric pathway can always exist at all locations relative to the electric pathway between the first electric heating element and the second electric heating element. In such way, the bypass electric pathway formed by switching to the short-circuit condition and accordingly can always exist at all locations relative to the electric pathway between the first electric heating element and the second electric heating element, so that an electric pathway can be ensured and the emitter can be lighted even when a line of any part is broken.

Effect of the Invention

An emitter and an X-ray tube device having the same according to the aspect of the first invention comprises: an electron emission surface having electric pathway; a first branched terminal and a second branched terminal that are two branched terminals branched in the middle of the electric pathway of the electron emission surface between the first electric heating element and the second electric heating element, in order from the first electric heating element. Further, the emitter and the X-ray tube device having the same the first switching element that switches the first electric heating element and the second branched terminal to a short-circuit condition or an open condition; and the second switching element that switches the second electric heating element and the first branched terminal to a short-circuit condition or an open condition. Such first switching element and second switching element are equipped, so that a bypass electric pathway can be formed at the location where the short-circuit condition is switched on; and accordingly, such bypass electric pathway can be always exist at all locations relative to the electric pathway between the first electric heating element and the second electric heating element, so that an electric pathway can be ensured even when the line of any location is broken and the emitter can be lighted.

The emitter, according to the aspect of the second invention, comprises: the electron emission surface having the electric pathway; and the first electric heating element and the second electric heating element that are connected electrically to both ends of the electron emission surface. And the emitter comprises: a first branched terminal, a second branched terminal, a third branched terminal, . . . , a n−2 branched terminal, a n−1 branched terminal, and a n-branched terminal, n is an integer bigger than 3, that are n branched terminals branched in the middle of the electric pathway of the electron emission surface between the first electric heating element and the second electric heating element in order from the first electric heating element. Further, the emitter further comprises: a first switching element that switches the first electric heating element and the second branched terminal to the short-circuit condition or the open condition; a second switching element that switches the first branched terminal and the third branched terminal to the short-circuit condition or the open condition; . . . ; a n−1 switching element that switches the n−2 branched terminal and the n branched terminal to the short-circuit condition or the open condition; and a n switching element that switches the n−1 branched terminal and the second electric heating element to the short-circuit condition or the open condition. Such first switching element, second switching element, . . . , n−1 switching element, and n switching element are equipped, so that a bypass electric pathway can be formed at the location where the short-circuit condition is switched on; and accordingly, such bypass electric pathway can be always exist at all locations relative to the electric pathway between the first electric heating element and the second electric heating element, so that an electric pathway can be ensured even when the line of any location is broken and the emitter can be lighted.

The above and other objects, aspects, features and advantages of the present invention will become apparent from the following description read in conjunction with the accompanying drawings, in which like reference numerals designate the same elements.

BRIEF DESCRIPTION OF THE DRAWINGS

FIG. 14A, 14B, 14C, 14D are schematic views illustrating the single emitter.

FIG. 16A, 16B, 16C, 16D are schematic views illustrating the triple emitter.

DETAILED DESCRIPTION OF THE PREFERRED EMBODIMENTS

Figure 1:
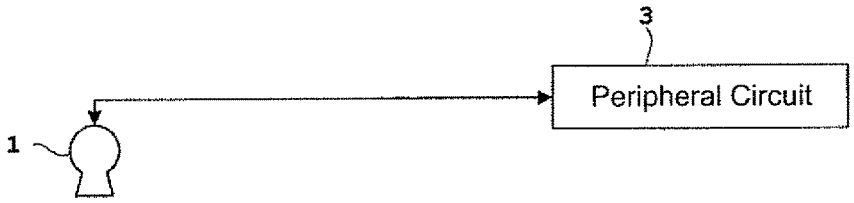
FIG. 1 is a block diagram illustrating an X-ray apparatus in association with each Embodiment.

Reference will now be made in detail to embodiments of the invention. Wherever possible, same or similar reference numerals are used in the drawings and the description to refer to the same or like parts or steps. The drawings are in simplified form and are not to precise scale. The words 'couple', 'pathway', 'via', 'vias', and similar terms do not necessarily denote direct and immediate connections, but also include connections through intermediate elements or devices. For purposes of convenience and clarity only, directional (up/down, etc.) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Various operations may be described as multiple discrete operations in turn, in a manner that may be helpful in understanding embodiments of the present invention; however, the order of description should not be construed to imply that these operations are order dependent.

Embodiment 1

Referring to Figures, the inventor sets forth the Embodiment 1 of the present invention.

Figure 2:
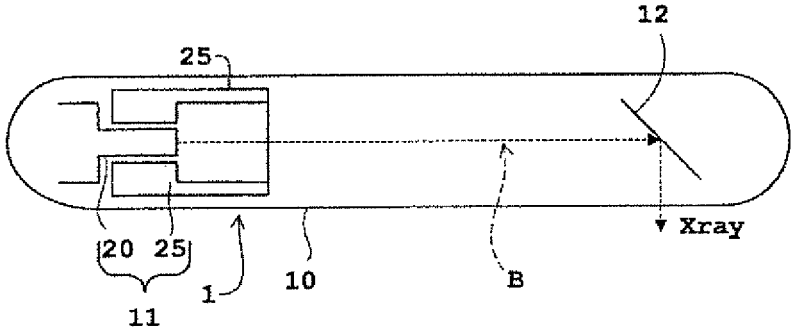
FIG. 2 is a schematic view diagram illustrating an X-ray apparatus in association with each Embodiment.
Figure 3:
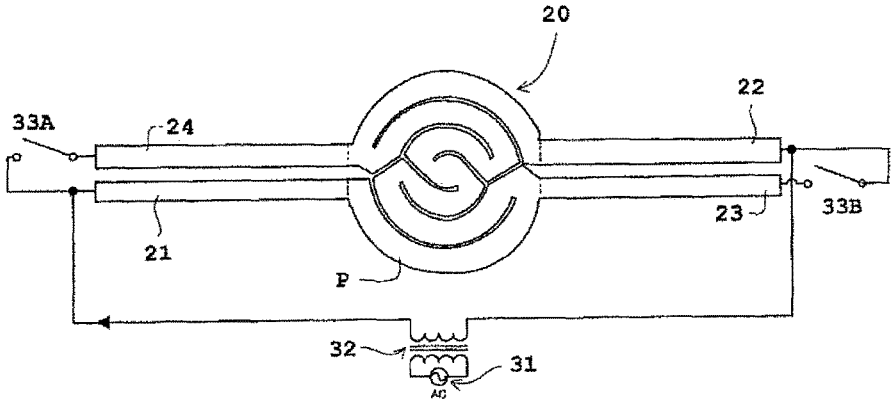
FIG. 3 is a schematic plane view illustrating a flat emitter (double emitter) for a X-ray tube and peripheral circuits thereof according to the aspect of the Embodiment 1.
Figure 4:
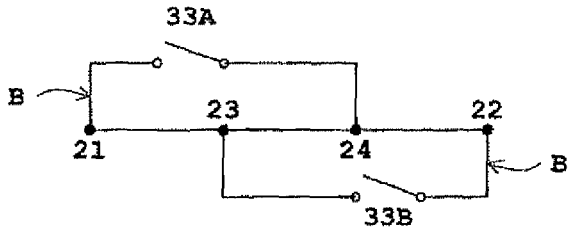
FIG. 4 is a schematic explanation view illustrating an electric pathway and a bypass electric pathway of the flat emitter (double emitter) for the X-ray tube according to the aspect of the Embodiment 1.
Figure 5:
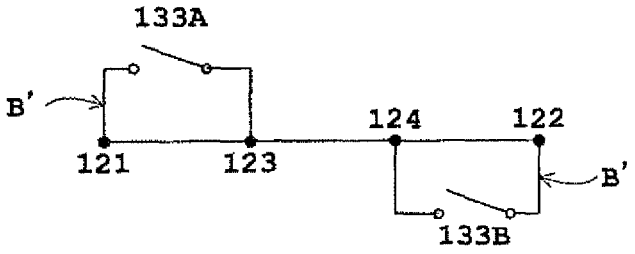
FIG. 5 PRIOR ART
FIG. 5 is a schematic explanation view illustrating an electric pathway in the FIG. 8 disclosed in Patent Document 2, which is referred to comparison with FIG. 4.
Figure 8:
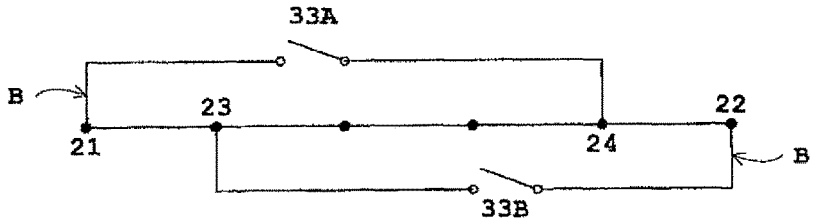
FIG. 8 is a schematic explanation view illustrating an electric pathway and a bypass electric pathway of the flat emitter (triple emitter) for the X-ray tube according to the aspect of the Embodiment 2.

FIG. 1 is a block diagram illustrating an X-ray apparatus in association with each Embodiment, FIG. 2 is a schematic view diagram illustrating an X-ray apparatus in association with each Embodiment, FIG. 3 is a schematic plane view illustrating a flat emitter (double emitter) for a X-ray tube and peripheral circuits thereof according to the aspect of the Embodiment 1, FIG. 4 is a schematic explanation view illustrating an electric pathway and a bypass electric pathway of the flat emitter (double emitter) for the X-ray tube according to the aspect of the Embodiment 1, FIG. 5 is a schematic explanation view illustrating an electric pathway in the FIG. 8 disclosed in Patent Document 2, which is referred to comparison with FIG. 4, and FIG. 6A, 6B, 6C are schematic explanation views illustrating the electric pathway of the flat emitter (double emitter) when the lines thereof are broken according to the aspect of the Embodiment 1. The inventor sets forth an emitter according to the above aspect of Embodiment 1, as well as Embodiment 2, 3 set forth later, referring to an flat emitter for X-ray tube that is employed as an electron source of an X-ray tube, and such flat emitter has an emitter with a supporting element, in which each supporting element is concurrently used as a branched terminal for electrical heating.

Referring to FIG. 1, an X-ray apparatus comprises an X-ray tube device 1 that irradiates X-rays and a periphery circuit 3 that controls the X-ray tube device 1. Other than such elements, the X-ray apparatus comprises a flat panel X-ray detector (FPD) that detects X-rays irradiated from the X-ray tube device 1 and transmitted through a subject (not shown in FIG.) and an image processing element (not shown in FIG.) that executes an image processing based on the X-ray detected by the FPD to obtain an X-ray image and so forth. Such elements are not characteristic elements of the present invention or related to characteristic elements of the present invention, so that the explanation is not provided. Said periphery circuit 3 that controls open or short-circuit of relays 33A, 33*b* (not shown in FIG.) set forth later corresponds to a switching control element of the present invention.

Referring to FIG. 2, an X-ray tube comprises an envelope 10, and an anode 11 and a cathode 12 inside the envelope 10. In addition, the anode 11 comprises a flat emitter 20 for the X-ray tube and a convergence electrode 25. A specific configuration as to the emitter (double emitter) according to the aspect of the Embodiment 1 is set forth later referring to FIGS. 3, 4, and 6. In addition, referring to FIG. 2, the X-ray tube device is not limited a type in which an X-ray is irradiated from the perpendicular direction to the light axis of the electron beam B, but the X-ray tube device may be a type in which an X-ray is irradiated from the parallel direction to the light axis of the electron beam B.

Referring to FIG. 3, in the periphery of the X-ray tube device 1, a periphery circuit 3 that controls the X-ray tube device comprises an alternative electric current source 31 (also referring to FIG. 6) and an electric transformer 32 (also referring to FIG. 6). In addition, in any case of that a line of any part of the flat emitter 20 (double emitter according to the aspect of the Embodiment 1) for the X-ray tube is broken, the relay 33A, 33B that switch the electric heating element as an end terminal and the supporting element as a branched terminal to a short-circuit condition or an open condition, and the bypass electric power supply are equipped. Secondary electric current that passes through the X-ray flat emitter is adjusted by adjusting the primary side electric current of the electric transformer 32. The relay 33A corresponds to the first switching element of the present invention and the relay 33B corresponds to the second switching element of the present invention.

Referring to FIG. 3 and FIG. 6, the emitter 20 for the X-ray tube that is circular and comprises a pair of (two) electric heating elements 21, 22 and a pair of (two) supporting elements 23, 24 at the base of the circular electron emission surface P. The elements 21 to 24 are bent in 90° at the broken line in FIG. and electricity passes through the element 21, 22 so as to heat the electron emission surface P and to irradiate thermal electrons from the electron emission surface P. The thermal electron (referring to electron beam B in FIG.) irradiated from the electron emission surface P collides with the cathode (referring to FIG. 2), so that an X-ray emits (indicated by X-ray in FIG. 2).

In such way, the electric heating elements 21, 22 are end terminals electrically connected to both ends of the electron emission surface P having the electric pathway. In addition, the supporting element 23 and the supporting element 24 are in order from the electric heating element 21. Accordingly, the supporting elements 23, 24 are two branched terminals branched in the middle of the electric pathway of the electron emission surface P. The electric heating element 21 corresponds to the first electric heating element of the present invention and the electric heating element 22 corresponds to the second electric heating element of the present invention. In addition, the supporting elements 23, 24 correspond to the branched terminal of the present invention and the supporting element 23 corresponds to the first branched terminal of the present invention and the supporting element 24 corresponds to the second branched terminal of the present invention.

In addition, referring to FIG. 3 and FIG. 6, according to the aspect of the Embodiment 1, the relay 33A outside the electric pathway switches the electric heating element 21 and the supporting element 24, which is normally farthest from the electric heating element 21 on the electric pathway, to the short-circuit condition or the open condition. In addition, the relay 33B outside the electric pathway switches the electric heating element 22 and the supporting element 23, which is normally farthest from the electric heating element 22 on the electric pathway, to the short-circuit condition or the open condition.

In addition, referring to FIG. 2, the convergence electrode 25 houses the flat emitter 20 for the X-ray tube. The convergence electrode 25 controls the size of the focal point from the flat emitter 20 for the X-ray tube. The convergence electrode 25 is electrically connected to a bias electric power supply (not shown in FIG.) and if the flat emitter 20 for the X-ray tube is a reference voltage, minus bias electric voltage is added to the convergence electrode 25.

Under normal condition, i.e., when the line of the electric pathway relative to the electron emission surface P is not broken, the periphery circuit 3 (referring to FIG. 1) controls the relays 33A, 33B to be in the open condition and the flat emitter 20 for the X-ray tube heats the entire of the flat emitter 20 for the X-ray tube by energizing from the electric heating elements 21, 22. Alternating current source 31 adjusts the alternating current and supplies the electric heating elements 21, 22 with electricity via a electric transformer. Temperature distribution of the emitter is approximately even on the plan, but the temperature of the central part is somewhat high. After the emitter is being used for a long time, the line near by the central part is broken in many cases when the evaporation of the emitter proceeds. However, the location where the line is broken may vary depending on the use conditions (e.g., electric current and time on electrical heating). In any cases, the electric current (filament electric current) passing through the electric heating elements 21, 22 is always monitored, so that detection of that the line is broken can be facilitated.

Referring to FIG. 4, the electric pathway is schematically shown as a straight line and each bypass electric pathway having the relays 33A, 33B outside the electric pathway is shown as next to the electric pathway. In addition, for comparison, the electric pathway referring to FIG. 8 of Patent Document 2 is schematically shown in FIG. 5 as shown in FIG. 4. Referring to FIG. 4 and FIG. 5, black circles indicate terminals for electrical heating, including the electric heating element as the end terminal and the branched terminal of the electric heating element.

Referring to FIG. 4, according to the aspect of the Embodiment 1, the relay 33A short-circuits, so that the bypass electric pathway B can be formed between the electric heating element 21 and the supporting element 24, and in addition, the relay 33B short-circuits, so that the bypass electric pathway B can be formed between the electric heating element 22 and the supporting element 23. Accordingly, such bypass electric pathway B can always exist at all locations relative to the electric pathway between the first electric heating element 21 and the second electric heating element 22. As results, even when the line of any location is broken, the relay corresponding to the line-broken location can short-circuit, so that the electric pathway can be ensured through the bypass electric pathway B.

On the other hand, referring to FIG. 5, according to the aspect illustrated in FIG. 8 of Patent Document 2, Embodiment 1, the relay 133A short-circuits, so that the bypass electric pathway B' can be formed between the electric heating element 121 and the supporting element 123 nearest to such electric heating element 121 on the electric pathway under normal condition, and in addition, the relay 133B short-circuits, so that the bypass electric pathway B' can be formed between the electric heating element 122 and the supporting element 124 nearest to such electric heating element 121 on the electric pathway under normal condition. Accordingly, the central part between the supporting elements 123 and 124 has no bypass electric pathway B'. As results, if the line of the central parts between the supporting elements 123 and 124 is broken, no electric pathway can be formed.

Figure 6A:
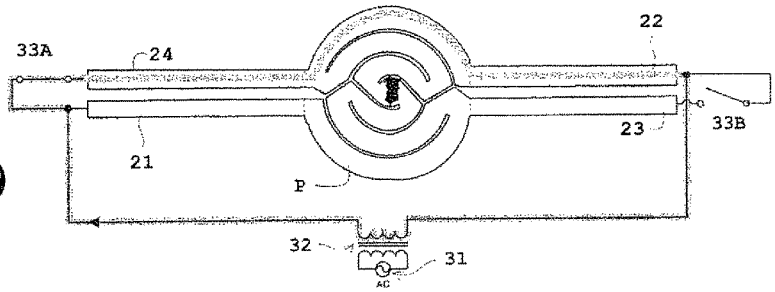
FIG. 6A, 6B, 6C are schematic explanation views illustrating the electric pathway of the flat emitter (double emitter) when the lines thereof are broken according to the aspect of the Embodiment 1.
Figure 6B:
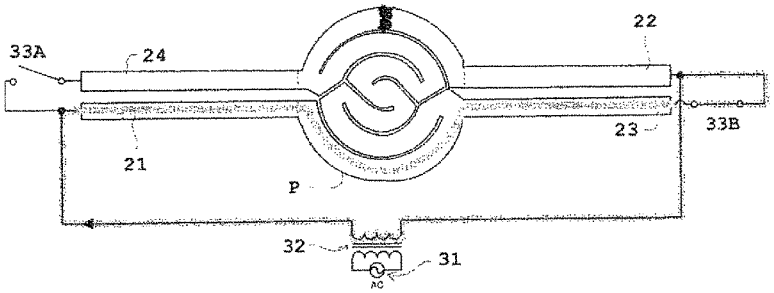
Figure 6C:
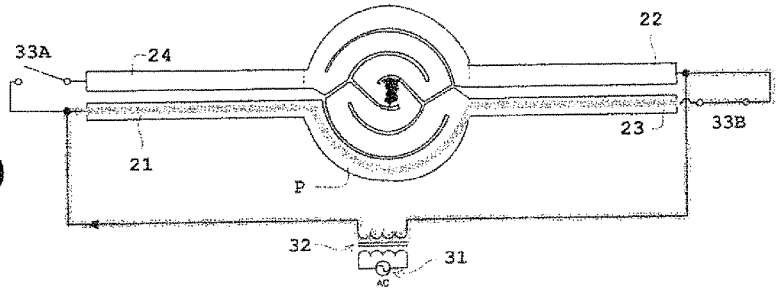

Referring to FIG. 6A, 6B, 6C, the inventor sets forth the specific Embodiment 1 when a line of a double emitter is broken. The thick line in FIG. 6A, 6B, 6C is the electric pathway including the bypass electric pathway B (referring to FIG. 4) when the line is broken. For example, referring to FIG. 6A, even when the line of the central part is broken, the relay 33A short-circuits so that the electric pathway can be ensured and the emitter can be partially lighted.

For example, referring to FIG. 6B, even when the line of the central part is broken, the relay 33B short-circuits so that the electric pathway can be ensured and the emitter can be partially lighted. Further, referring to FIG. 6A, when the line of the central part is broken, the relay 33A should not short-circuit as illustrated in FIG. 6A and instead, the relay 33B can short-circuit as illustrated in FIG. 6C.

Not shown in FIG., but also when the line of the periphery part between the electric heating element 21 and the supporting element 23 is broken, the relay 33A short-circuits so that the electric pathway can be ensured and the emitter can partially light. In summary, when the line of any location of the electric pathway on the electron emission surface P is broken, the periphery circuit 3 (referring to FIG. 1); the relay 33A corresponding to the first switching element is controlled in the short-circuit condition and the relay 33B is controlled in the open condition; and only the pathway connecting the supporting element 24 corresponding to the second branched terminal and the electric heating element 22 corresponding to the second electric heating element is used as the electric pathway (referring to FIG. 6A). Or, the periphery circuit 3; the relay 33A corresponding to the first switching element is controlled in the open condition and the relay 33B is controlled in the short-circuit condition; and only the pathway, of the electric pathway, connecting the supporting element 23 corresponding to the first branched terminal and the electric heating element 21 corresponding to the first electric heating element is used as the electric pathway (referring to FIG. 6B and FIG. 6C).

At this time, the lighting area when the line is broken is smaller than the normal lighting area (an entire surface of the flat emitter 20 for the X-ray tube. Accordingly, the focal point is formed only based on a partial area when the line is broken, so that the size of such focal point when the line is broken is larger than the size of the normal focal point. Accordingly, the quality of image is damaged, but a condition under which an emergent fluoroscopy (e.g., under clinical treatment) can be accomplished can be ensured.

Preferably, negative bias voltage (e.g., approximately minus several hundred volts) is applied to the convergence electrode 25. In such way, electrons from the emitter 20 for the X-ray tube converge due to the bias voltage applied to the convergence electrode 25. The size of the focal point can be made relatively small thereby.

Further, the electric current (filament electric current) passing through the electric heating elements 21, 22 is always monitored, so that detection of the broken line can be facilitated. Accordingly, when the line is broken and filament electric current cannot be detected even if one relay short-circuits, the periphery circuit 3 can automatically control so as to open such short-circuited relay and short-circuit another relay. In addition, in accordance with design conditions of the emitter or application conditions set forth above, the location of the broken line can be estimated more or less, so that when the line is broken and filament electric current cannot be detected even if the relay corresponding to such estimated location of the broken line short-circuits, the periphery circuit 3 can automatically control so as to open such short-circuited relay and short-circuit another relay.

The emitter 20, for the X-ray tube according to the aspect of the present Embodiment 1, comprises: an electron emission surface P having the electric pathway; the first electric heating element (electric heating element 21 referring to FIG. 3 and FIG. 6A, 6B, 6C) and the second electric heating element (electric heating element 22 referring to FIG. 3 and FIG. 6A, 6B, 6C) that are electrically connected to both ends of the electron emission surface; the first branched terminal (supporting element 23 referring to FIG. 3 and FIG. 6A, 6B, 6C) and the second branched terminal (supporting element 24 referring to FIG. 3 and FIG. 6A, 6B, 6C) that are two branched terminals branched in the middle of the electric pathway of the electron emission surface between the first electric heating element (electric heating element 21) and the second electric heating element (electric heating element 22) in order from the first electric heating element. Further, the emitter 20, for the X-ray tube, comprises the first switching element (relay 33A referring to FIG. 3 and FIG. 6A, 6B, 6C) that switches the first electric heating element (electric heating element 21) and the second branched terminal (supporting element 24) to a short-circuit condition or an open condition; and the second switching element (relay 33B referring to FIG. 3 and FIG. 6A, 6B, 6C) that switches the second electric heating element (electric heating element 22) and the first branched terminal (supporting element 23) to a short-circuit condition or an open condition. Such first switching element (relay 33A) and second switching element (33B) are equipped, so that a bypass electric pathway B (referring to FIG. 4) can be formed at the location where the short-circuit condition is switched on and accordingly, such bypass electric pathway can always exist at all locations relative to the electric pathway between the first electric heating element (electric heating element 21) and the second electric heating element (electric heating element 22). In such way, the bypass electric pathway formed by switching to the short-circuit condition and accordingly can be always exist at all locations relative to the electric pathway between the first electric heating element (electric heating element 21) and the second electric heating element (electric heating element 22), so that an electric pathway can be ensured and the emitter (flat emitter 20 for X-ray tube) can be lighted even when the line of any part is broken.

The aspect of the present Embodiment 1 is applied to a double emitter that comprises a pair of branched terminals (supporting elements, 23, 24). In addition, referring to FIG. 3, the relay 33A outside the electric pathway switches the electric heating element 21 and the second branched terminal (supporting element 24), which is normally farthest from the electric heating element 21 on the electric pathway, to the short-circuit condition or the open condition. In addition, the relay 33B outside the electric pathway switches the electric heating element 22 and the first branched terminal (supporting element 23), which is normally farthest from the electric heating element 22 on the electric pathway, to the short-circuit condition or the open condition. Accordingly, when applied to the double emitter as the aspect of the present Embodiment 1, and if the line of any location is broken, the electric pathway can be ensured so as to light the double emitter.

Such emitter according to the aspect of the present Embodiment 1, including Embodiments, 2, 3 set forth later, is applied to an X-ray tube device. Further, when the line of any location of the electric pathway relative to the electron emission surface P is broken, a switching control element (periphery circuit 3 in FIG. 1) controls the first switching element (relay 33A referring to FIG. 3 and FIG. 6A, 6B, 6C) to be in short-circuit condition and the second switching element (relay 33B referring to FIG. 3 and FIG. 6A, 6B, 6C) to be in the open condition, so that only the pathway connecting the second branched terminal (supporting element 24 referring to FIG. 3 and FIG. 6A, 6B, 6C) and the second electric heating element (electric heating element 22 referring to FIG. 3 and FIG. 6A, 6B, 6C) is used as an electric pathway; or the first switching element (relay 33A) to be in the open condition and the second switching element (relay 33B) to be in the short-circuit condition, so that only the pathway connecting the first branched terminal (supporting element 23 referring to FIG. 3 and FIG. 6A, 6B, 6C) and the first electric heating element (electric heating element 21 referring to FIG. 3 and FIG. 6A, 6B, 6C) is used as an electric pathway. The electric pathway is used in such way, so that the emitter can be lighted even in emergency (e.g., clinical treatment) and an X-ray can be irradiated from the X-ray tube device.

Embodiment 2

Next, referring to FIGs, the inventors set forth the Embodiment 2 of the present invention.

Figure 7A:
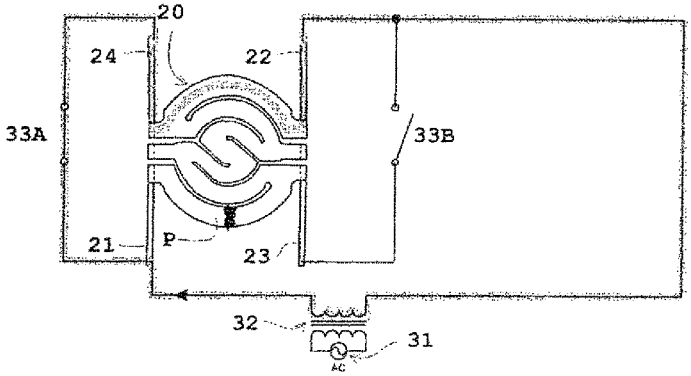
FIG. 7A, 7B, 7C are schematic explanation views illustrating the electric pathway of the flat emitter (double emitter) when the lines thereof are broken according to the aspect of the Embodiment 2.
Figure 7B:
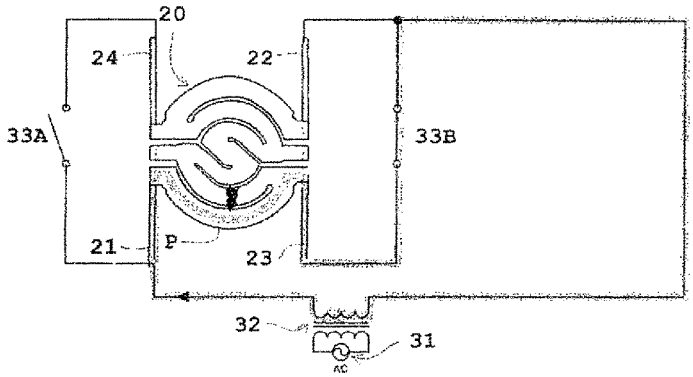
Figure 7C:
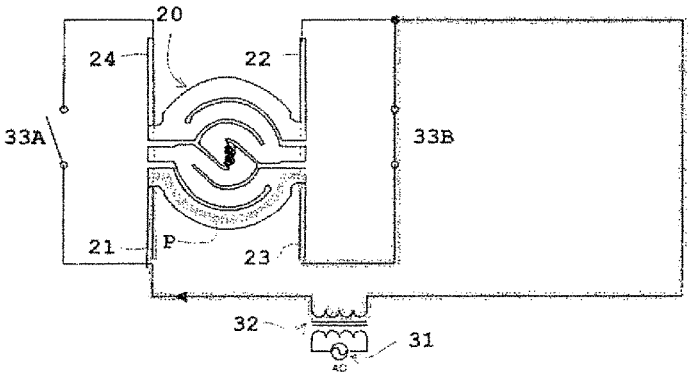

FIG. 7A, 7B, 7C are schematic explanation views illustrating the electric pathway of the flat emitter (double emitter) when the lines thereof are broken according to the aspect of the Embodiment 2, and FIG. 8 is a schematic explanation view illustrating an electric pathway and a bypass electric pathway of the flat emitter (triple emitter) for the X-ray tube according to the aspect of the Embodiment 2. The same element as the above Embodiment 1 is indicated by the same sign and the illustration thereof is omitted. An X-ray is irradiated from the X-ray tube device as set forth above according to the aspect of the Embodiment 1 referring to FIG. 2, and an X-ray image is output from the X-ray tube device as set forth above according to the aspect of the Embodiment 1 referring to FIG. 1.

The aspect of the Embodiment 1 set for above is applied to a double emitter that comprises a pair of branched terminals (supporting elements, 23, 24) and here the aspect of the present Embodiment 2, including the Embodiment 3 set forth later, is applied to a triple emitter that comprises two pairs of branched terminals. Specifically, as well as the aspect of the Embodiment 1 set forth above, according to the aspect of the Embodiment 2, an emitter 20, for the X-ray tube, is circular referring to FIG. 7A, 7B, 7C. And the emitter 20, for the X-ray tube, that is circular and comprises two pairs of (four) supporting elements including a pair of (two) electric heating elements 21, 22 and a pair of (two) supporting elements 23, 24, at the base of the circular electron emission surface P. In addition, according to the aspect of the Embodiment 2, the signs indicating supporting elements corresponding to the target branched terminal that short-circuit or open are 23, 24.

In addition, referring to FIG. 7, according to the aspect of the Embodiment 2, the relay 33A outside the electric pathway switches the electric heating element 21 and the supporting element 24, which is normally farthest from the electric heating element 21 on the electric pathway, to the short-circuit condition or the open condition. In addition, the relay 33B outside the electric pathway switches the electric heating element 22 and the supporting element 23, which is normally farthest from the electric heating element 22 on the electric pathway, to the short-circuit condition or the open condition.

Referring to FIG. 8, as set forth above referring to FIG. 4 according to the aspect of the Embodiment 1, the electric pathway is schematically shown as a straight line and each bypass electric pathway B having the relays 33A, 33B outside the electric pathway is shown as next to the electric pathway. Referring to FIG. 8, black circles indicate terminals for electrical heating, including the electric heating element as the end terminal and the branched terminal of the electric heating element.

On the other hand, referring to FIG. 8, according to the aspect of the present Embodiment 2, the relay 33A short-circuits, so that the bypass electric pathway B can be formed between the electric heating element 21 and the supporting element 24 farthest to such electric heating element 21 on the electric pathway under normal condition, and in addition, the relay 33B short-circuits, so that the bypass electric pathway B can be formed between the electric heating element 22 and the supporting element 23 farthest to such electric heating element 22 on the electric pathway under normal condition. Accordingly, such bypass electric pathway B can always exist at all locations relative to the electric pathway between the first electric heating element 21 and the second electric heating element 22. As results, even when the line of any location is broken, the relay corresponding to the line-broken location can short-circuit, so that the electric pathway can be ensured through the bypass electric pathway B.

Figure 19:
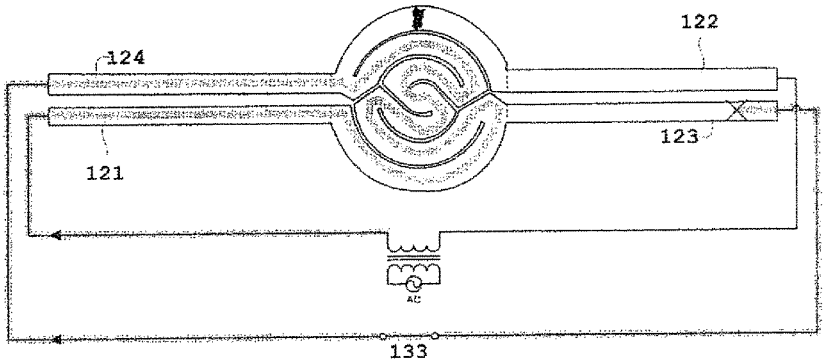
FIG. 19 is illustrating the electric pathway of double emitter when the line of the circumference part is broken according to the aspect referring to FIG. 17.
Figure 20:
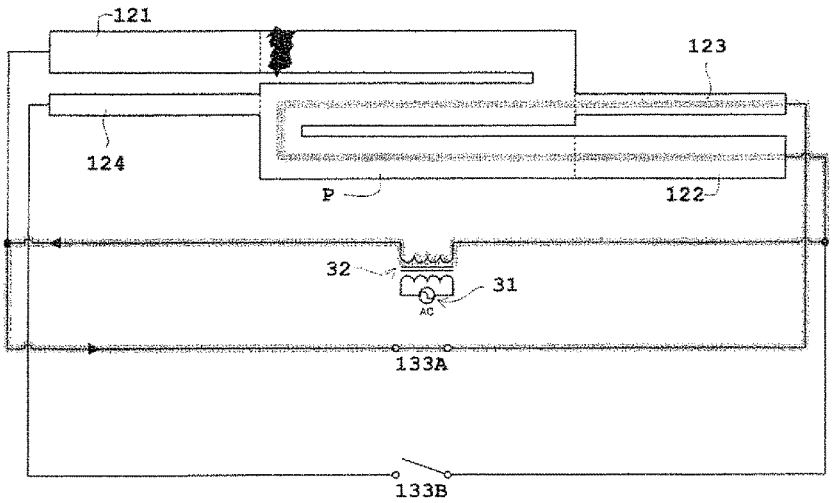
FIG. 20 PRIOR ART
FIG. 20 is illustrating the electric pathway of double emitter when the line of the circumference part is broken according to the aspect referring to FIG. 8 disclosed in Patent Document 2.
Figure 21:
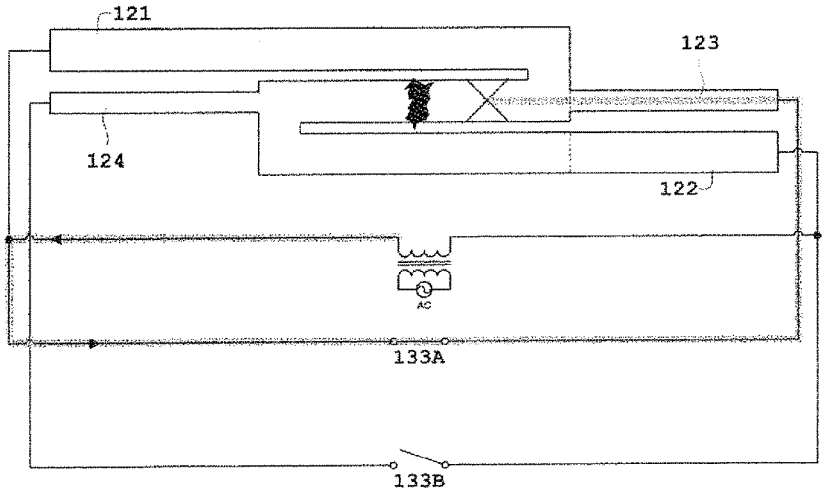
FIG. 21 PRIOR ART
FIG. 21 is illustrating the electric pathway of double emitter when the line of the circumference part is broken according to the aspect referring to FIG. 8 disclosed in Patent Document 2.

Referring to FIG. 7A, 7B, 7C, the inventor sets forth the specific Embodiment 2 when a line of a triple emitter is broken. As well as FIG. 19 and FIG. 21 and FIG. 6 of the Embodiment 1 set forth above, the thick line in FIG. 7A, 7B, 7C is the electric pathway including the bypass electric pathway B (referring to FIG. 8) when the line is broken. For example, referring to FIG. 7A, even when the line of the outermost peripheral part is broken, the relay 33A short-circuits so that the electric pathway can be ensured and the emitter can be partially lighted.

For example, referring to FIG. 7B, even when the line of the innermost peripheral part near the supporting element 23 is broken, e.g., the relay 33B short-circuits so that the electric pathway can be ensured and the emitter can be partially lighted. For example, referring to FIG. 7C, even when the line of the central part is broken, e.g., the relay 33B short-circuits so that the electric pathway can be ensured and the emitter can be partially lighted. When the line of the outermost peripheral part between the electric heating element 22 and the supporting element 24 is broken, the relay 33B should not short-circuit, and instead, the relay 33A can short-circuit, as illustrated in FIG. 7B, FIG. 7C.

Specifically, when the line of the outermost peripheral part between the electric heating element 21 and the supporting element 23, the relay 33A can short-circuits; when the line of the outermost peripheral part between the electric heating element 22 and the supporting element 24 is broken, the relay 33B can short-circuit, and when the line other than such parts is broken, either relay 33A or relay 33B can short-circuit. In summary, according to the aspect of the present Embodiment 2 as well as the Embodiment 1 set forth above, when the line of any location of the electric pathway on the electron emission surface P is broken, the periphery circuit 3 (referring to FIG. 1); the relay 33A corresponding to the first switching element is controlled in the short-circuit condition and the relay 33B is controlled in the open condition; and only the pathway connecting the supporting element 24 corresponding to the second branched terminal and the electric heating element 22 corresponding to the second electric heating element is used as the electric pathway (referring to FIG. 7A). Or, the periphery circuit 3; the relay 33A corresponding to the first switching element is controlled in the open condition and the relay 33B is controlled in the short-circuit condition; and only the pathway, of the electric pathway, connecting the supporting element 23 corresponding to the first branched terminal and the electric heating element 21 corresponding to the first electric heating element, is used as the electric pathway (referring to FIG. 7B and FIG. 7C).

The emitter 20, for the X-ray tube according to the aspect of the present Embodiment 2, comprises: an electron emission surface P having the electric pathway; and two pairs of the first electric heating element (electric heating element 21 referring to FIG. 7) and the second electric heating element (electric heating element 22 referring to FIG. 7) that are electrically connected to both ends of the electron emission surface P; and the branched terminals (supporting elements including supporting elements 23,24 referring to FIG. 7). Practically, two pairs of (total four) supporting elements are available as branched terminals, but according to the aspect of the present Embodiment 2, the supporting element 23 nearest to the electrical heating element 21 is used as the first branched terminal and the supporting element 24 farthest from the electrical heating element 21 is used as the second branched terminal. Further, the emitter 20, for the X-ray tube, comprises the first switching element (relay 33A referring to FIG. 7A, 7B, 7C) that switches the first electric heating element (electric heating element 21) and the second branched terminal (supporting element 24) to a short-circuit condition or an open condition; and the second switching element (relay 33B referring to FIG. 7A, 7B, 7C) that switches the second electric heating element (electric heating element 22) and the first branched terminal (supporting element 23) to a short-circuit condition or an open condition. Such first switching element (relay 33A) and second switching element (33B) are equipped, so that a bypass electric pathway B (referring to FIG. 8) can be formed at the location where the short-circuit condition is switched on and accordingly, such bypass electric pathway can always exist at all locations relative to the electric pathway between the first electric heating element (electric heating element 21) and the second electric heating element (electric heating element 22). In such way, the bypass electric pathway formed by switching to the short-circuit condition and accordingly can always exist at all locations relative to the electric pathway between the first electric heating element (electric heating element 21) and the second electric heating element (electric heating element 22), so that an electric pathway can be ensured and the emitter (flat emitter for X-ray tube) can be lighted even when the line of any part is broken.

The aspect of the present Embodiment 2 is applied to a triple emitter that comprises two pairs of branched terminals (supporting elements including supporting elements 23, 24). Specifically, referring to FIG. 7, the relay 33A outside the electric pathway switches the electric heating element 21 and the second branched terminal (supporting element 24), which is normally farthest from the electric heating element 21 on the electric pathway, to the short-circuit condition or the open condition. In addition, the relay 33B outside the electric pathway switches the electric heating element 22 and the first branched terminal (supporting element 23), which is normally farthest from the electric heating element 22 on the electric pathway, to the short-circuit state or the open condition. Accordingly, when applied to the double emitter as the aspect of the present Embodiment 2, and if the line of any location is broken, the electric pathway can be ensured so that the double emitter can light.

Embodiment 3

Next, referring to FIGs, the inventors set forth the Embodiment 3 of the present invention.

Figure 9A:
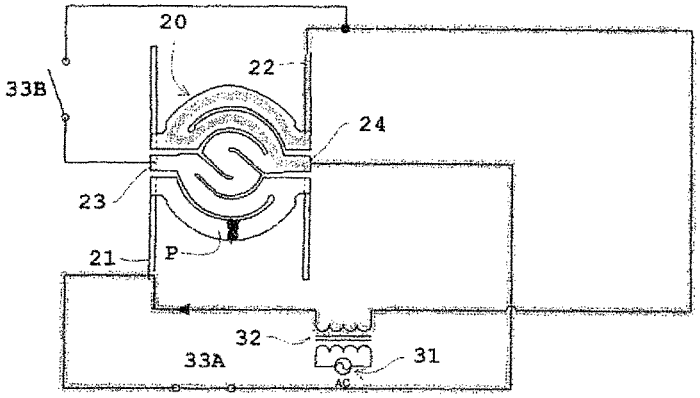
FIG. 9A, 9B, 9C are schematic explanation views illustrating the electric pathway of the flat emitter (double emitter) when the lines thereof are broken according to the aspect of the Embodiment 3.
Figure 9B:
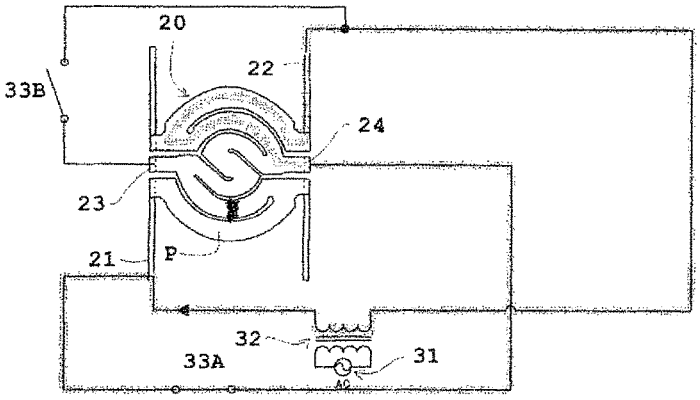
Figure 9C:
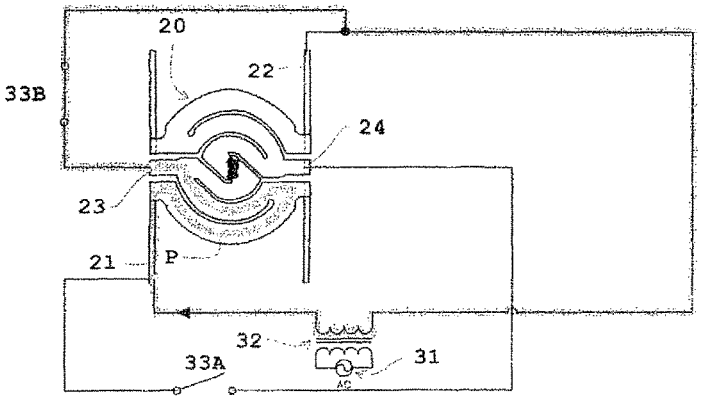
Figure 10:
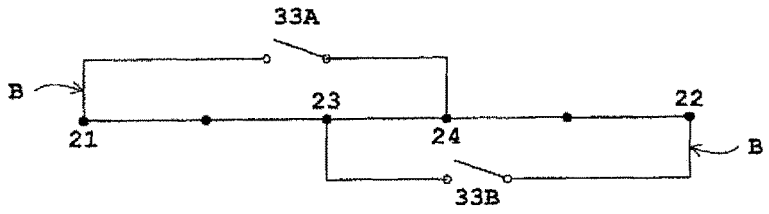
FIG. 10 is a schematic explanation view illustrating an electric pathway and a bypass electric pathway of the flat emitter (triple emitter) for the X-ray tube according to the aspect of the Embodiment 3.

FIG. 9A, 9B, 9C are schematic explanation views illustrating the electric pathway of the flat emitter (triple emitter) when the lines thereof are broken according to the aspect of the Embodiment 3, and FIG. 10 is a schematic explanation view illustrating an electric pathway and a bypass electric pathway of the flat emitter (triple emitter) for the X-ray tube according to the aspect of the Embodiment 3. The same element as the above Embodiment 1,2 is indicated by the same sign and the illustration thereof is omitted. An X-ray is irradiated from the X-ray tube device as set forth above according to the aspect of the Embodiment 1, 2 referring to FIG. 2, and an X-ray image is output from the X-ray tube device as set forth above according to the aspect of the Embodiment 1, 2 referring to FIG. 1

The aspect of the Embodiment 1 set forth above is applied to a double emitter that comprises a pair of branched terminals (supporting elements, 23, 24) and here the aspect of the present Embodiment 3, as well as the Embodiment 2 set for later such, is applied to a triple emitter that comprises two pairs of branched terminals. Specifically, as well as the aspect of the Embodiment 1, 2 set forth above, according to the aspect of the Embodiment 3, an emitter 20, for the X-ray tube, is circular referring to FIG. 9A, 9B, 9C. And the emitter 20, for the X-ray tube, that is circular and comprises two pairs of (four) supporting elements including a pair of (two) electric heating elements 21, 22 and a pair of supporting elements 23, 24, at the foot of the circular electron emission surface P. In addition, according to the aspect of the Embodiment 3, as well as the Embodiment 2 set forth above, the signs indicating supporting elements corresponding to the target branched terminal that short-circuits or opens are 23, 24.

In addition, referring to FIG. 7, the relay 33A outside the electric pathway switches the electric heating element 21 and the supporting element 24, which is normally farthest from the electric heating element 21 on the electric pathway, to the short-circuit condition or the open condition; and further, the relay 33B outside the electric pathway switches the electric heating element 22 and the supporting element 23, which is normally farthest from the electric heating element 22 on the electric pathway, to the short-circuit condition or the open condition. On the other hand, the relay 33A, outside the electric pathway, short-circuits the electric heating element 21 and the supporting element 24, which is normally second farthest from the electric heating element 21 on the electric pathway, to the short-circuit condition. In addition, the relay 33B outside the electric pathway switches the electric heating element 22 and the supporting element 23, which is normally second farthest from the electric heating element 22 on the electric pathway, to the short-circuit condition or the open condition.

Referring to FIG. 10, as well as FIG. 1, FIG. 4 of the Embodiment 1 and FIG. 8 of the Embodiment 1 set forth above, the electric pathway is schematically shown as a straight line and each bypass electric pathway B having the relays 33A, 33B outside the electric pathway is shown as next to the electric pathway. Referring to FIG. 10, black circles indicate terminals for electrical heating, including the electric heating element as the end terminal and the branched terminal of the electric heating element.

Referring to FIG. 10, according to the aspect of the present Embodiment 3, the relay 33A short-circuits, so that the bypass electric pathway B can be formed between the electric heating element 21 and the supporting element 24 second farthest from such electric heating element 21 on the electric pathway under normal condition, and in addition, the relay 33B short-circuits, so that the bypass electric pathway B can be formed between the electric heating element 22 and the supporting element 23 second farthest from such electric heating element 22 on the electric pathway under normal condition. Accordingly, such bypass electric pathway B can always exist at all locations relative to the electric pathway between the electric heating element 21 and the electric heating element 22. As results, even when the line of any location is broken, the relay corresponding to the line-broken location can short-circuit, so that the electric pathway can be ensured through the bypass electric pathway B. Further, compared FIG. 8 of the aspect of Embodiment 2 set forth above, the longer electric pathway except bypass electric pathway B is ensured, the larger area of emission surface capable of lighting can be ensured.

Referring to FIG. 9A, 9B, 9C, the inventor sets forth the specific Embodiment 3 when a line of a triple emitter is broken. The thick line in FIG. 9A, 9B, 9C, as well as FIG. 18, FIG. 19, FIG. 20, FIG. 21, FIG. 6 according to the aspect of the Embodiment 1 and FIG. 7 according to the aspect of the Embodiment 2, is the electric pathway including the bypass electric pathway B (referring to FIG. 10) when the line is broken. For example, referring to FIG. 9A, even when the line of the outmost peripheral part is broken, the relay 33A short-circuits so that the electric pathway can be ensured and the emitter can be partially lighted.

For example, referring to FIG. 9B, even when the line of the peripheral part near inside is broken, the relay 33A short-circuits so that the electric pathway can be ensured and the emitter can be partially lighted. For example, referring to FIG. 9C, even when the line of the central part is broken, the relay 33B short-circuits so that the electric pathway can be ensured and the emitter can be partially lighted. Further, referring to FIG. 9C, when the line of the central part is broken, the relay 33B should not short-circuit as illustrated in FIG. 9C, and instead, the relay 33A can short-circuit as illustrated in FIG. 9C. Compared with FIG. 7 according to the aspect of the Embodiment 2, it is confirmed that the triple emitter according to the aspect of the present Embodiment 3 provides a larger area of the emitter emission surface capable of lighting when the line is broken.

The inventor will not set forth the principal action and effect of the flat emitter for X-ray tube according to the aspect of the present Embodiment 3 because of the same as the Embodiment 2 set forth above. However, according to the aspect of the present Embodiment 2, the supporting element 23 nearest to the electrical heating element 21 is used as the first branched terminal and the supporting element 24 farthest from the electrical heating element 21 is used as the second branched terminal. In contrast, according to the aspect of the present Embodiment 3, the supporting element 23 second nearest to the electrical heating element 21 is used as the first branched terminal and the supporting element 24 second farthest from the electrical heating element 21 is used as the second branched terminal.

The aspect of the present Embodiment 3, as well as the Embodiment 2 set forth above, is applied to a triple emitter that comprises two pairs of branched terminals (supporting elements including supporting elements 23, 24). Specifically, referring to FIG. 9, the relay 33A outside the electric pathway switches the electric heating element 21 and the second branched terminal (supporting element 24), which is second farthest from the electric heating element 21 on the electric pathway under normal condition, to the short-circuit condition or the open condition. In addition, the relay 33B outside the electric pathway switches the electric heating element 22 and the first branched terminal (supporting element 23), which is second farthest from the electric heating element 22 on the electric pathway under normal condition, to the short-circuit state or the open condition. Accordingly, when applied to the triple emitter as the aspect of the present Embodiment 3, and if the line of any location is broken, the electric pathway can be ensured so as to light the triple emitter. Further, compared FIG. 8 of the aspect of Embodiment 2 set forth above, the larger area of emission surface capable of lighting can be ensured.

The present invention is not limited to the aspects of Embodiment set forth above and further another alternative Embodiment can be implemented set forth below.

(1) Specific configuration of an X-ray tube device comprising an emitter is not particularly limited. For example, such configuration can be applied to an envelope rotatable medical X-ray tube, in which a cathode and the envelope enveloping the same rotate as a single unit.

(2) Each Embodiment is applied to an X-ray tube device, but also can be applied to an electron source that irradiates an electron beam without irradiating an X-ray. For example, the emitter of the present invention can be applied to an electron beam analyzer.

(3) Such X-ray apparatus can be an medical diagnostic X-ray apparatus for diagnosing a subject and also can be an industrial X-ray apparatus for a nondestructive inspection apparatus.

(4) According to the aspect of each Embodiment set forth above, the inventor sets forth a flat emitter as an example, but the emission surface of electron beam is not mandatory to be flat. Nevertheless, if the flat emitter has a flat electron emission surface, the emitter can be installed to a flat surface, so that the focal point can be more preciously controlled. Further, the branched terminal for the electric heating is an element bent at right angle (90°), but the branched terminal is not limited to such element. For example, another branched terminal of the electric heating can be installed other than the element holding the emitter pathway.

Figure 11:
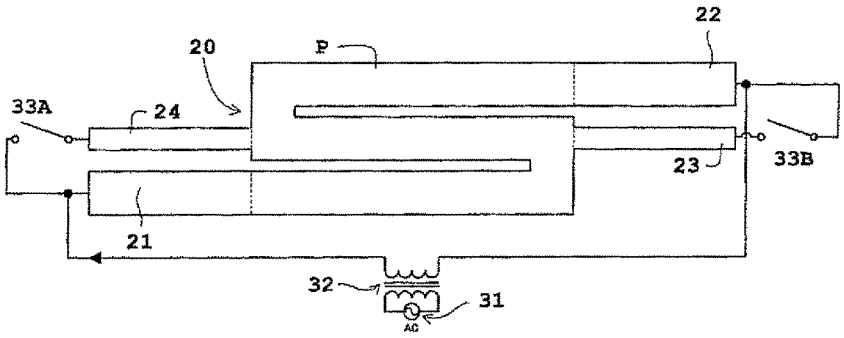
FIG. 11 is a schematic plane view illustrating a flat emitter (double emitter) for a X-ray tube and peripheral circuits thereof according to the aspect of the alternative Embodiment.

(5) According to the aspect of each Embodiment set forth above, the flat emitter is circular referring to FIG. 3, FIG. 6A, 6B, 6C, FIG. 7A, 7B, 7C, FIG. 9A, 9B, 9C, but the shape of the emitter is not limited to such circular shape. For example, referring to FIG. 11, each Embodiment can be also applied to the rectangular emitter (the flat emitter, for X-ray tube, comprising the double emitter referring to FIG. 11). In addition, each Embodiment can be also applied to a triple emitter having also rectangular shape as well as Embodiments 2, 3 and further can be applied to the emitter having at least three pairs of branched terminals and the rectangular shape as illustrated in alternative Embodiment (6), (6) The Embodiment 1 set forth above is applied to a double emitter and the Embodiment 2, 3 set forth above are applied to a triple emitter, but also such Embodiments can be applied to an emitter comprising at least 3 of branched terminals.

Figure 12:
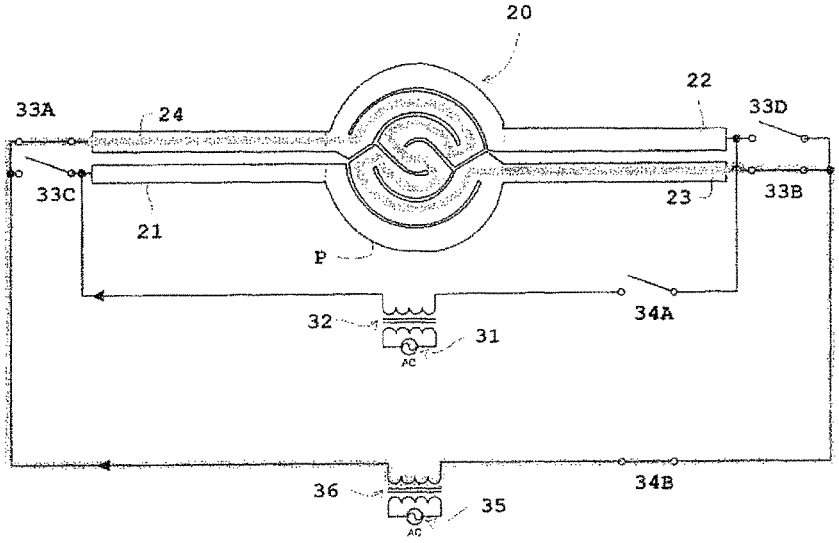
FIG. 12 is a schematic plane view illustrating a flat emitter (double emitter) combining a semi-light electrical heating element for an X-ray tube and peripheral circuits thereof according to the aspect of another alternative Embodiment.
Figure 13A:
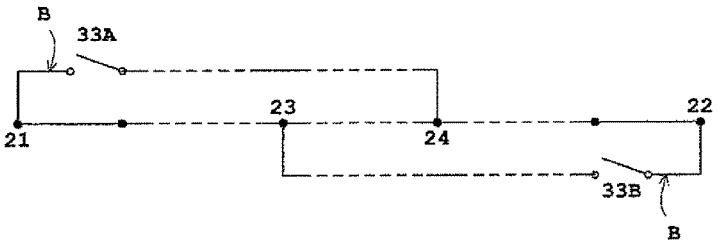
FIG. 13A, 13B are schematic explanation views illustrating each example of the electric pathway and the bypass electric pathway of the emitter having at least three pairs of supporting elements as branched terminals according to the aspect of another Embodiment.
Figure 13B:
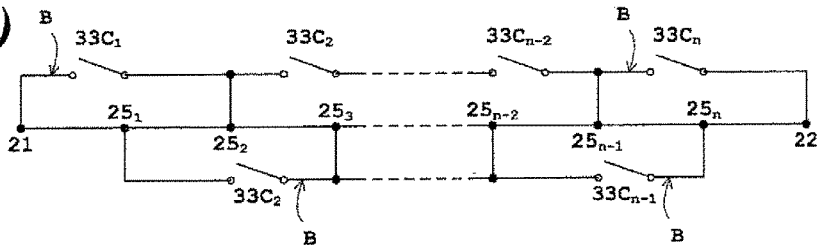
Figure 15A:
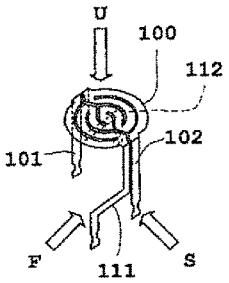
FIG. 15A, 15B, 15C, 15D are schematic views illustrating the double emitter.
Figure 15B:
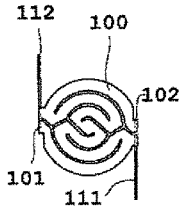
Figure 15C:
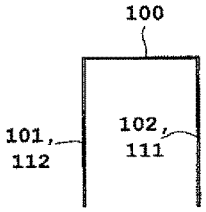
Figure 15D:
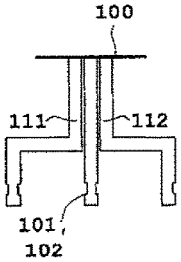
Figure 17:
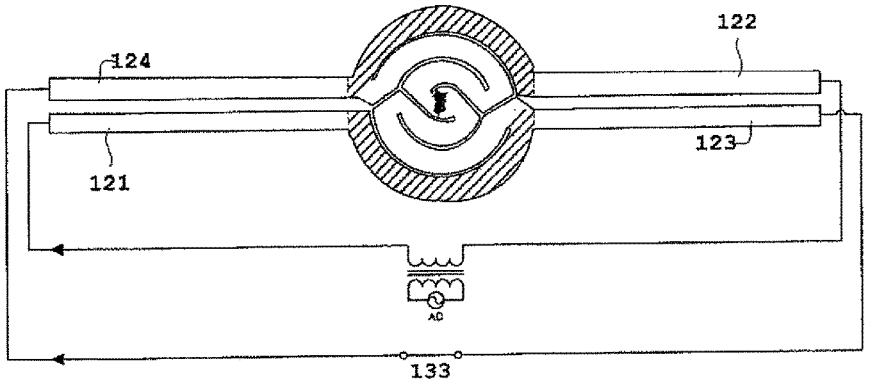
FIG. 17 is a schematic view illustrating a double emitter so as to short-circuit the electric pathway near the location of the broken line with a relay.
Figure 18:
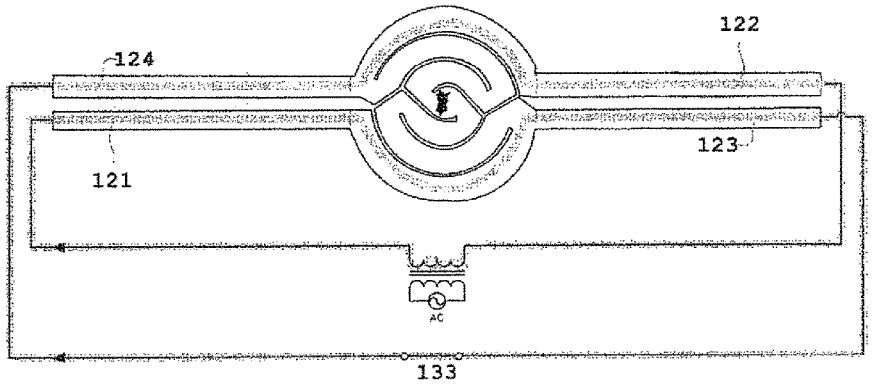
FIG. 18 is illustrating an electric pathway of double emitter when the line of the central part is broken according to the aspect referring to FIG. 17.

(7) According to the aspect of each Embodiment set forth above, the supporting element, referring to FIG. 3, FIG. 6A, 6B, 6C, FIG. 7A, 7B, 7C, FIG. 9A, 9B, 9C, is only used as a branched terminal or electrical heating when the line is broken, but also can be used as a half-light electrical heating element that lights only a narrower area than the entire area of electron emission surface P referring to FIG. 12. Specifically, referring to FIG. 12, am switching relay (relay 34A for entire light electrical heating and 34B for half-light electrical heating) to switch entire light electrical heating and half-light electrical heating; and an alternating-current source 35 for half-light electrical heating and an electric transformer 36 connected to such alternating-current source 35; are equipped. A relay 33C is installed in the side of the relay 33A and a relay 33D is installed in the side of the relay 33B other than relays 33A, 33B as well as each Embodiment. Electrical heating is conducted in the pathway from the electric heating element 21, the supporting element 23, the supporting element 22, to the electric heating element 24, in order, by opening the rest of relays but only using the relay 34A to short-circuit so as to light the entire surface of the electron emission surface P. Electrical heating is conducted in the pathway from the relay 33A, the supporting element 24, the supporting element 23, to the relay 33B, in order, and by opening the rest of relays using the relay 34B, as indicated by the solid line referring to FIG. 12, and the relays 33A, 33B to short-circuit so as to light the narrower area than the entire surface of the electron emission surface P. When the line of the central part broken, under short-circuited condition using the relay 34A, e.g., the relays 33A, 33C or the relays 33B, 33D short-circuit. When the line of the peripheral part between the electric heating element 21 and the supporting element 23 is broken, the relays 33A, 33C are used to short-circuit under the short-circuit condition using the relay 33A. When the line of the peripheral part between the electric heating element 22 and the supporting element 24 is broken, the relays 33B, 33D are used to short-circuit under the short-circuit condition using the relay 34A. Referring to FIG. 12, the case of the circular emitter is shown but the case of the rectangular emitter is the same as set forth above. In addition, such aspect can be applicable to even the triple emitter according to the aspect of the Embodiment 2, 3, and the emitter having at least three branched terminals according to the alternative Embodiment 6 referring to FIG. 6, (8) Referring to FIG. 13A, 13B, the emitter comprising at least 3 pairs of branched terminals according to the aspect of the alternative Embodiment 6 can have the bypass electric pathway B. Referring to FIG. 13, as well as FIG. 4 of the Embodiment 1 and FIG. 8 of the Embodiment 2, FIG. 10 of the Embodiment 3 set forth above, the electric pathway is schematically shown as a straight line and each bypass electric pathway B having the relays 33A, 33B near the electric pathway is shown as next to the electric pathway. Referring to FIG. 13, black circles indicate terminals for electrical heating, including the electric heating element as the end terminal and the branched terminal of the electric heating element. In addition, referring to FIG. 13A, the supporting elements 23, 24 corresponding to the branched terminal targeted to be short-circuited or opened are arranged side by side from the electric heating element 21, the supporting element 23, the supporting element 24 and the electric heating element 22 in order relative the electric pathway. Referring to FIG. 13A, the relay 33A short-circuits, so that the bypass electric pathway B can be formed between the electric heating element 21 and the supporting element 24, and in addition, the relay 33B short-circuits, so that the bypass electric pathway B can be formed between the electric heating element 22 and the farther supporting element 23.

In addition, referring to FIG. 13B, the emitter comprises: the first branched terminal (supporting element 251), the second branched terminal (supporting element 252), the third branched terminal (supporting element 253), . . . , the n−2 branched terminal (supporting element 25*n*−2), the n−1 branched terminal (supporting element 25*n*−1), and the n-branched terminal (supporting element 25*n*), n is an integer bigger than 3, that are n branched terminals branched in the middle of the electric pathway of the electron emission surface between the first electric heating element (electric heating element 21) and the second electric heating element (electric heating element 22) in order from the first electric heating element (electric heating element 21). Further, the emitter comprises: the first switching element (relay 33C1) switches the first electric heating element (electric heating element 21) and the second branched terminal (supporting element 252) to the short-circuit condition or the open condition; the second switching element (relay 33C2) switches the first branched terminals (supporting element 251) and the third branched terminal (supporting element 253) to the short-circuit condition or the open condition; . . . ; the n−1 switching element (relay 33Cn−1) switches the n−2 electric heating element (supporting element 25*n*−2) and the n branched terminal (supporting element 25*n*) to the short-circuit condition or the open condition; the n switching element (relay 33Cn) switches the n−1 branched terminals (supporting element 25*n*−1) and the second electric heating element (electric heating element 22) to the short-circuit condition or the open condition;

In addition, referring to FIG. 13B, the first branched terminal (supporting element 251), the second branched terminal (supporting element 252), the third branched terminal (supporting element 253), the n−2 branched terminal (supporting element 25*n*−2), the n−1 branched terminal (supporting element 25*n*−1), and the n branched terminal are (supporting element 25*n*) are not only adjacent each other, but single or plural branched terminals also can be away each other.

Referring to FIG. 13B, when the emitter is applied to the X-ray tube device 1 (referring to FIG. 1, FIG. 2), the switching element (peripheral circuit 3 referring to FIG. 3), as set forth below, controls the first branched terminal (supporting element 251), the first branched terminal (supporting element 251), the second branched terminal (supporting element 252), the third branched terminal (supporting element 253), the n−2 branched terminal (supporting element 25*n*−2), the n−1 branched terminal (supporting element 25*n*−1), the n branched terminal (supporting element 25*n*) to be opened or short-circuited. Specifically, when the line of the electric pathway on the electron emission surface P is not broken, the first branched terminal (supporting element 251), the first branched terminal (supporting element 251), the second branched terminal (supporting element 252), the third branched terminal (supporting element 253), the n−2 branched terminal (supporting element 25*n*−2), the n−1 branched terminal (supporting element 25*n*−1), the n branched terminal (supporting element 25*n*) are controlled as open.

When any singular or plural lines of the electron emission surface P are broken, the first electric heating element (electric heating element 21), the second electric heating element (electric heating element 22) or the switching element connected to the branched terminal, nearest to the broken lines, are controlled to be short-circuit and the rest are controlled to be open and the first electric heating element (electrical heating element 21), the second electric heating element (electric heating element 22) or only the pathway connecting the branched terminal are used as the electric pathway.

For example, the line connecting the electric heating element 21 and the supporting element 251 is broken, the switching element nearest to the broken part is the first switching element (relay 33C1), so that the first switching element (relay 33C1) is controlled to be short-circuited and the rest of the switching elements are controlled to be opened, and the second electric heating element (electric heating element 22) among the electric pathways connected to the rest of the switching element or the pathway connecting the branched terminals are uses as an electric pathway.

For example, when the line of the part connecting the supporting element 251 and the supporting element 252 is broken, the switching element nearest the line broken part is the second switching element (relay 33C2) connected to the supporting element 251, or the first switching element (relay 33C1) connected to the supporting element 252. Accordingly, the second switching element (relay 33C2) is controlled to be short-circuited and the rest of the switching elements are controlled to be opened, and the first electric heating element (electric heating element 21), among the electric pathways, connected to the rest of the switching element, the second electric heating element (electric heating element 22) or the pathway connecting the branched terminals are only used as an electric pathway. Or, the second electric heating element (electric heating element 22), among the electric pathways, connected to the rest of the switching element or the pathway connecting the branched terminals is only used as an electric pathway.

Field of the Invention

As set forth above, the present invention is suitable for an X-ray tube and an electron source, and in addition, an X-ray fluoroscopic apparatus and an X-ray imaging apparatus.

REFERENCE OF SIGN

1 X-ray tube (radiation source)
3 Peripheral circuit
20 Flat emitter for X-ray tube
21, 22 Electrical heating element
23, 24 Supporting element
251, 252, 253, . . . , 25*n*−2, 25*n*−1, 25*n* . . . Supporting element
33A, 33B Relay
33C1, 33C2, . . . , 33Cn−1, 33Cn . . . Relay
P Electron emission surface
B Bypass electric pathway It will be further understood by those of skill in the art that the apparatus and devices and the elements herein, without limitation, and including the sub components such as operational structures, circuits, communication pathways, electrical connections, electrical routes, etc., and related elements, control elements of all kinds, display circuits and display systems and elements, any necessary driving elements, inputs, sensors, detectors, memory elements, processors and any combinations of these structures etc. as will be understood by those of skill in the art as also being identified as or capable of operating the systems and devices and subcomponents noted herein and structures that accomplish the functions without restrictive language or label requirements since those of skill in the art are well versed in related X-Ray device technologies including any related computer and operational controls and technologies of radiographic devices and all their sub components, including various circuits and combinations of circuits without departing from the scope and spirit of the present invention.

Although only a few embodiments have been disclosed in detail above, other embodiments are possible and the inventors intend these to be encompassed within this specification. The specification describes certain technological solutions to solve the technical problems that are described expressly and inherently in this application. This disclosure describes embodiments, and the claims are intended to cover any modification or alternative or generalization of these embodiments which might be predictable to a person having ordinary skill in the art.

Also, the inventors intend that only those claims which use the words "means for" are intended to be interpreted under 35 USC 112, sixth paragraph. Moreover, no limitations from the specification are intended to be read into any claims, unless those limitations are expressly included in the claims.

Where a specific numerical value is mentioned herein, if any, it should be considered that the value may be increased or decreased by 20%, while still staying within the teachings of the present application, unless some different range is specifically mentioned. Where a specified logical sense is used, the opposite logical sense is also intended to be encompassed.

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

What is claimed is:

1. An emitter, for an X-ray tube device, comprising:

an electron emission surface having at least one electric pathway;

a first electric heating element and a second electric heating element that are connected electrically to both ends of said electron emission surface; and a first and a second branched terminal that are respectively branched in a middle of said electric pathway of said electron emission surface between said first electric heating element and said second electric heating element, in order from said first electric heating element; and which further comprises:

a first switching element that switches said first electric heating element and said second branched terminal to a short-circuit condition or an open condition; and a second switching element that switches said second electric heating element and said first branched terminal to a short-circuit condition or an open condition.

2. An X-ray tube device, having the emitter according to claim 1, comprising:

a switching control element to control a short-circuit condition or an open-circuit condition of each said first switching element and said second switching element;

wherein said switching control element controls said open-circuit when said electric pathway on said emission surface is not broken; and wherein when a line of any part of said electric pathway of said electron emission surface is broken, said switching control element controls said first switching element to be in the short-circuit condition and said second switching element to be in the open-circuit condition, so that only a designated pathway, of said at least one electric pathways, connecting said second branched terminal; and said second electric heating element is used as a operative electric pathway; or said first switching element to be in the open-circuit condition and said second switching element to be in the short-circuit condition, so that only the designated pathway, among said at least one electric pathways, connecting the first branched terminal and the first electric heating element is used as said electric pathway.

3. An emitter, for an X-ray tube device, comprising:

an electron emission surface having an electric pathway;

a first electric heating element and a second electric heating element that are connected electrically to both ends of the electron emission surface; and a plurality of branched terminals including a first branched terminal, a second branched terminal, a third branched terminal, a n−2 branched terminal, a n−1 branched terminal, and a n-branched terminal, wherein n is an integer bigger than 3, wherein the plurality of n branched terminals are branched in the middle of said electric pathway of said electron emission surface between said first electric heating element and said second electric heating element that are connected electrically to both ends of said electron emission surface, in order from said first electric heating element; and further comprising:

a first switching element that switches said first electric heating element and said second branched terminal to a short-circuit condition or an open condition; a second switching element that switches said first branched terminal and said third branched terminal to the short-circuit condition or the open condition; . . . ; a n−1 switching element that switches said n−2 branched terminal and said n branched terminal to the short-circuit condition or the open condition; and a n switching element that switches said n−1 branched terminal and said second electric heating element to the short-circuit condition or the open condition.

4. An X-ray tube device, having the emitter according to claim 3, comprising:

a switching control element that controls a short-circuit condition or an open-circuit condition of said first switching element and said second switching element; said third switching element; said n−2 switching element; said n−1 switching element; and said n switching element;

wherein said switching control element controls said first switching element and said second switching element; said third switching element; said n−2 switching element; said n−1 switching element; and said n switching element; to be in said open-circuit condition when said electric pathway on said emission surface is not broken; and wherein when any singular or plural lines of said electric pathway on the electron emission surface are broken, said first electric heating element nearest to a line broken part, said second electric heating element or a switching element connected to said branched terminal, are controlled to be in said short-circuit condition and a rest of said switching elements are controlled to be in the open-circuit condition; and said first electric heating element, said second electric heating element or only the pathway connecting said branched terminals is used as the electric pathway.

* * * * *